US005490717A

United States Patent [19]

Greene

[11] Patent Number: 5,490,717

[45] Date of Patent: Feb. 13, 1996

[54] LOTUS SEAT

[76] Inventor: James W. Greene, 853 Broadway, Suite 1516, New York, N.Y. 10003

[21] Appl. No.: 289,903

[22] Filed: Aug. 12, 1994

[51] Int. Cl.[6] ..... A47C 7/00

[52] U.S. Cl. ..... 297/452.41; 297/DIG. 3; 297/452.21; 297/467; 297/452.23; 5/654

[58] Field of Search ..... 297/452.25, 452.21, 297/452.23, 452.24, 452.26, 452.27, 452.28, 452.41, 467, DIG. 2, DIG. 3, 4; 5/654, 655

[56] References Cited

U.S. PATENT DOCUMENTS

| | | | |
|---|---|---|---|
| 3,306,658 | 2/1967 | Roberts | 297/4 |
| 3,376,070 | 4/1968 | Johnson | 297/452.25 X |
| 3,503,649 | 3/1970 | Johnson | 297/452.25 X |
| 4,232,477 | 11/1980 | Lin | 297/DIG. 3 X |
| 4,899,406 | 2/1990 | Sanderson et al. | 297/DIG. 3 X |
| 5,134,740 | 8/1992 | Summer | 297/452.48 X |

FOREIGN PATENT DOCUMENTS

| | | | |
|---|---|---|---|
| 2454782 | 11/1980 | France | 5/655 |
| 1115421 | 10/1961 | Germany | 297/452.25 |
| 2556025 | 6/1977 | Germany | 297/452.25 |

*Primary Examiner*—Milton Nelson, Jr.
*Attorney, Agent, or Firm*—Anthony J. Casella; Gerald E. Hespos

[57] ABSTRACT

A seating device is disclosed that offers comfort in use over extended periods of time and certain therapeutic effects as well as being readily portable and storable when not in use. The device is embodied in an inflatable seat that may be molded from thin, clear polyethylene/vinyl plastic material and formed with a flat thicker bottom surface, a concave seat area, a rising rear support, and a smaller frontal post section. The concave seat area is formed with an inherent forward tilt design which automatically aligns the spine of a user while the rear support provides additional comfort. The smaller frontal post section prevents forward sliding on and ride up of the rear of the seat. A valve is located in the bottom surface for inflating and deflating the seat and a snap strap may be provided for permanent closure after deflation and folding of the seat into itself.

9 Claims, 2 Drawing Sheets

LOTUS SEAT

BACKGROUND OF THE INVENTION

1. Field of the Invention

The present invention relates to a seating device and more specifically to an inflatable seat or cushion designed to allow relaxation of the muscles in the lumbar region and to reduce stress on the knee joints of a user particularly when seated in the "Lotus" position.

2. Description of the Prior Art

Many seating devices, such as chairs, pillows, and cushions, have been devised to achieve rest and relaxation. However, with a number of these devices, use for any extended period of time can frequently bring on discomfort due to the development of orthopedically incompatible stresses on the back or joints of a user. For example, a person sitting for long periods of time during a lecture or meditation must shift around to alter the concentrated forces which eventually may cause lack of blood flow to a body area or undue stress on the spine or certain muscles. In particular, a follower of various Yoga disciplines may be required to sit in the Lotus position for extended periods which can cause stiffening of the knee joints and lower back muscle fatigue. Resort to various pillows, pads, and props, while offering some relief still usually do not help greatly in the long run. Also, such paraphernalia are often cumbersome and may require carrying about and safekeeping and storage when not in use.

It is therefore a problem in the art to find a seating device that offers comfort over time, has therapeutic value, and is readily portable and storable when not in use.

3. Objects of the Invention

It is accordingly an object of the present invention to provide a seating device with improved comfort and therapeutic qualities.

It is another object of the invention to provide an improved seat that is contoured to provide orthopedically desirable forces on the body of a user for long term comfort.

It is also an object of the invention to provide an inflatable and deflatable seat that is simple in construction and readily portable and storable.

SUMMARY OF THE INVENTION

The present invention involves a seating device which offers comfort in use over extended periods of time and certain therapeutic effects as well as being readily portable and storable when not in use. The device is embodied in an inflatable seat that may be molded from thin, clear polyethylene/vinyl plastic material and formed with a flat thicker bottom surface, a concave seat area, a rising rear support, and a smaller frontal post section. The concave seat area is formed with an inherent forward tilt design involving oppositely upwardly inclined front and rear surfaces, the latter being longer, which automatically aligns the spine of a user. The rear support is forwardly tilted and upwardly narrowed to provide additional comfort. The smaller frontal post section is rearwardly tilted and upwardly narrowed to prevent forward sliding on and ride up of the rear of the seat and is contoured with the front of the seat to accommodate and elevate the legs of a user. A valve is located in the bottom surface for inflating and deflating the seat and a snap strap may be provided for permanent closure after deflation and tying about after folding of the seat into itself.

BRIEF DESCRIPTION OF THE DRAWING

The present invention will be described in more detail below with reference to the accompanying drawings in which.

DETAILED DESCRIPTION OF THE PREFERRED EMBODIMENT

Figure 1:
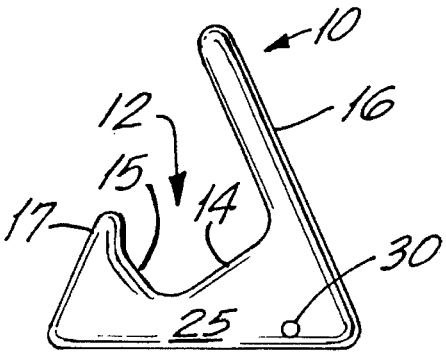
FIG. 1 is a side view of a seat device in accordance with the invention showing the concave seat area and the rising rear support and the frontal post section.
Figure 2:
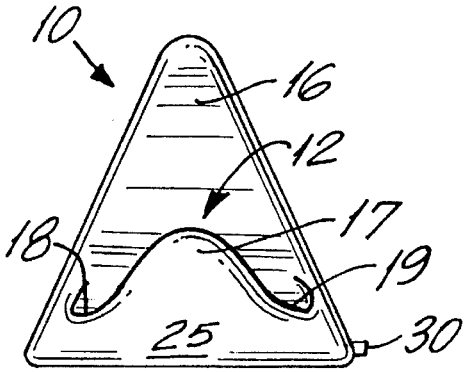
FIG. 2 is a front view of the seating device of FIG. 1.
Figure 3:
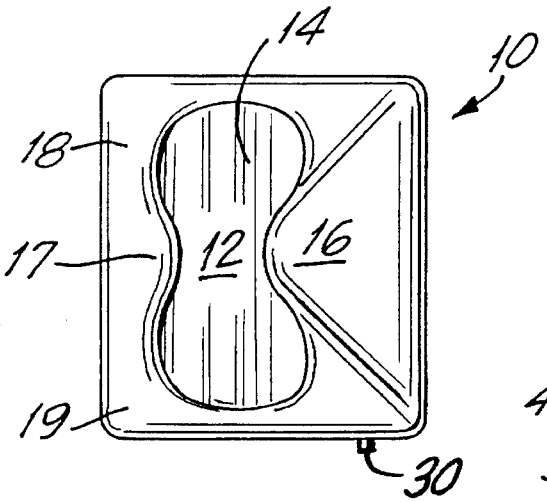
FIG. 3 is a top view of the seating device of FIG. 1.

As seen in FIG. 1 a seating device 10 in accordance with the invention is formed with a concave seat area 12 having an upwardly slanting surface 14 toward the rear and a shorter upwardly slanted surface 15 toward the front so as to produce an inherent forward tilt to the pelvis of a user seated thereon. A forwardly tilting, upwardly narrowing, rear support member 16 is formed above surface 14 and a somewhat smaller rearwardly tilted, upwardly narrowing frontal post section 17 is formed on the front above surface 15.

The frontal post section 17 is contoured in combination with the front of the seat area 12 (FIGS. 2, 3, 5, and 6) to form surfaces 18 and 19 which accommodate, and supportingly elevate the angle of, the legs or thighs of a sitter 20. The rear support member 16 provides support and comfort for the lower back, and the smaller frontal post section 17 prevents forward sliding on and ride up of the rear of the seat. The flat bottom area 25 forms the base which is disposed on a floor or other suitable supporting platform when the device 10 is used for seating by a user.

Orthopedic studies have discovered that a forwardly slanting seat and supportive leg cushion align the spine in an ideal sitting position, greatly reducing pressure on the lower lumbar region. Fatigue resulting from sitting in different positions and causing stress on the back, neck, and shoulder muscles is reduced considerably. Elevating the angle of the upper thighs improves circulation and decreases stress on the knee joints. The concave and contoured seat design of the invention accomplishes this proper orientation of the body of a user by rotating the pelvic bone slightly forward, thus tilting the sacral bone, which allows the muscles in the lumbar region to relax in turn, while the legs may be comfortably folded.

Figure 4:
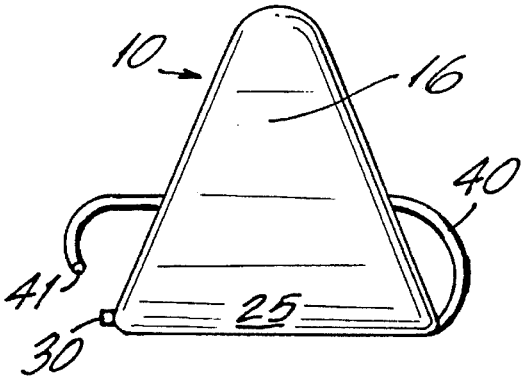
FIG. 4 is a rear view of the seating device of FIG. 1.
Figure 5:
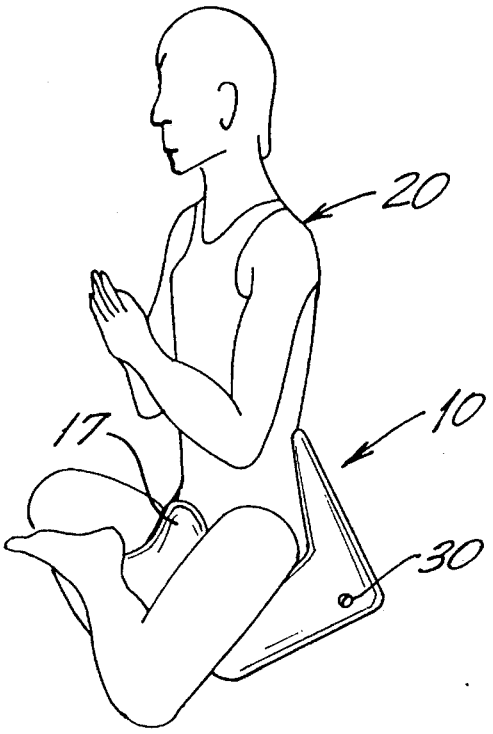
FIG. 5 is a view in perspective of a user seated in the seat device of FIG. 1 in the lotus position.
Figure 6:
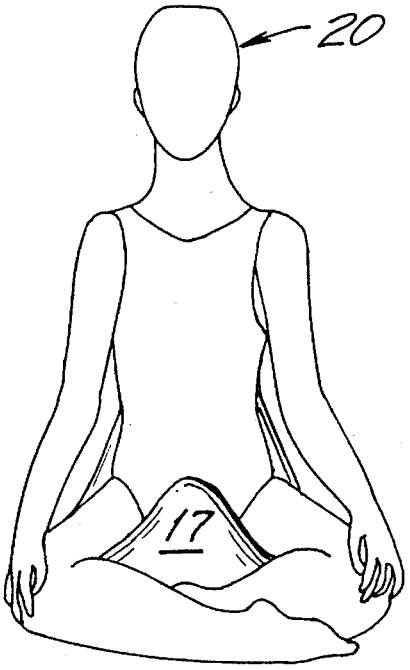
FIG. 6 is a front view of the user and seating device of FIG. 5.
Figure 7:
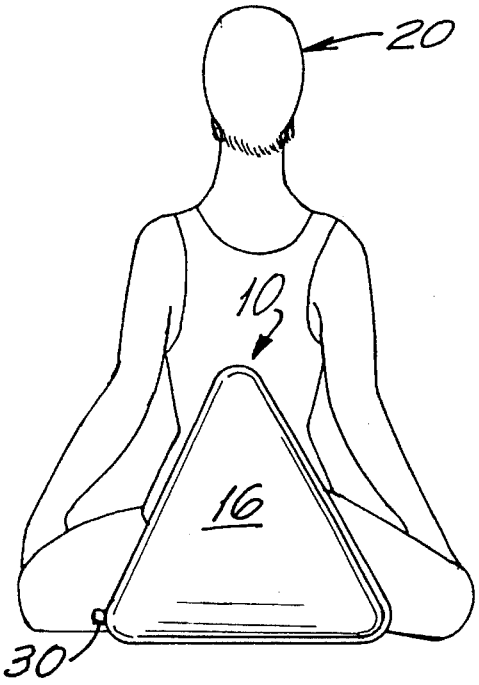
FIG. 7 is a rear view of the user and seating device of FIG. 5.

The entire seating device 10 may be formed from a moldable material, such as, preferably, thin, clear polyethylene/vinyl plastic with a hollow interior that can easily be inflated or blown up by the user. A valve 30 for inflating and deflating the device 10, by mouth or otherwise, may be formed in the flat bottom surface 25, or on one of the sides, and a snap strap 40 (FIG. 4) can be included with a stop 41 for permanent closure of the valve 30 after deflation, and for wrapping about the device 10 when folded up, after deflation, for storage.

The deflated device 10 may be easily carried about in the folded condition securely wrapped by the strap 40. When it is desired to use the device for seating, the strap 40 may be released by removing the stop 41 from the valve 30. The device 10 may be inflated by a user through placing the mouth over the valve 30 and blowing until a desired level of firmness or the inflation limit is reached. The user can then be seated in the concave and contoured seat area 12 facing the frontal post section 17 with the legs disposed on either side thereof. The contoured seat will produce an inherent forward tilt to the pelvis of a sitter aligning the spine in an ideal sitting position, thus greatly reducing pressure on the lower lumbar region. The contour elevates the angle of the upper thighs improving circulation and decreasing stress on the knee joints. After sitting for an extended period of time in comfort, the user may rise, deflate the device, wrap it up, and carry it off or simply store it for later use. Consequently, the device may be readily and conveniently used for various purposes such as Yoga exercises, meditations, listening to lectures, attending indoor or outdoor sporting events and other activities where a comfortable seat is desirable.

While the present invention has been described in terms of specific embodiments and combinations, it will be appreciated that the invention is not limited to the particular examples presented herein, and that the scope of the protection is defined in the attached claims.

What is claimed is:

1. A seating device for relaxation of lumbar region muscles and for reducing stress on knee joints of a user when seated in a lotus position, comprising:

means for accommodating the pelvis and thighs of said user and having a front and a rear;

concave seat means formed in said accommodating means, having a first surface upwardly slanting toward the rear and a second surface, shorter than said first surface, upwardly slanted toward the front, for producing a forward tilt to the pelvis of said user when seated thereon;

a forwardly tilting, upwardly narrowing, rear support member formed above said first surface on said accommodating means at the rear, the uppermost end of the rear support member being located forwardly of the lowermost end thereof; and a rearwardly tilted, upwardly narrowing front post member, smaller than said rear support member, formed at the end of said second surface on said accommodating means at the front.

2. A device as in claim 1, wherein said front post member is contoured in combination with said second surface to form third and fourth surfaces on either side of said post member for accommodating and supporting, at an elevated angle, the legs of said user.

3. A device as in claim 1, wherein said accommodating means further comprises a flat base supporting said concave seat means, said rear support member and said front post member.

4. A device as in claim 1, wherein said accommodating means is inflatable.

5. A device as in claim 4, wherein said accommodating means further comprises an inflation valve therein.

6. A device as in claim 4, wherein said accommodating means further comprises an attached strap means for securing said accommodating means when folded in a deflated condition.

7. A device as in claim 1, wherein said accommodating means is comprised of a moldable material.

8. A device as in claim 7, wherein said moldable material comprises thin, clear polyethylene/vinyl plastic.

9. A seating device comprising:

means for accommodating a user's pelvis and thighs and having a front and a rear, said accommodating means being inflatable and having an inflation valve therein, said accommodating means further including an attached strap means for securing said accommodating means when folded in the deflated condition, with said strap means being means for sealing said inflation valve;

concave seat means formed in said accommodating means, having a first surface upwardly slanting toward the rear and a second surface, shorter than said first surface, upwardly slanted toward the front, for producing a forward tilt to the pelvis of said user when seated thereon;

a forwardly tilting, upwardly narrowing, rear support member formed above said first surface on said accommodating means at the rear; and a rearwardly tilted, upwardly narrowing front post member, smaller than said rear support member, formed at the end of said second surface on said accommodating means at the front.

* * * * *